US005832329A

United States Patent [19]

Nemoto et al.

[11] Patent Number: 5,832,329

[45] Date of Patent: Nov. 3, 1998

[54] PROCESSING APPARATUS FOR LIGHT-SENSITIVE MATERIALS

[75] Inventors: Kazuhiro Nemoto; Teruo Kashino; Makoto Sumi, all of Hino, Japan

[73] Assignee: Konica Corporation, Tokyo, Japan

[21] Appl. No.: 631,811

[22] Filed: Apr. 12, 1996

[30] Foreign Application Priority Data

Apr. 12, 1995 [JP] Japan ..... 7-086745

[51] Int. Cl.[6] ..... G03D 3/02; G03D 3/08

[52] U.S. Cl. ..... 396/626; 396/612

[58] Field of Search ..... 396/603, 607, 396/612, 616, 617, 619, 620, 622, 627, 630, 626

[56] References Cited

U.S. PATENT DOCUMENTS 4,270,485 6/1981 Murosawa et al. ..... 118/648
4,388,396 6/1983 Nishibayashi et al. ..... 430/126
4,455,327 6/1984 Yoshida ..... 427/131
4,827,309 5/1989 Kato ..... 396/604
5,510,870 4/1996 Kashino et al. ..... 396/622

*Primary Examiner*—D. Rutledge
*Attorney, Agent, or Firm*—Frishauf, Holtz, Goodman, Langer & Chick, P.C.

[57] ABSTRACT

An apparatus for processing a light sensitive material comprises a conveying roller which provides a drop of water with a contact angle θ0 on a surface of the conveying roller, wherein the contact angle satisfies the following relation: $60° \leqq \theta \leqq 160°$, and a flow-creating device. The conveyor roller and the flow-creating device are adjusted so that the synthetic flow velocity is not slower than 80 mm/sec, wherein a synthetic flow velocity is composed of the conveying speed of the light sensitive material and the flow velocity of the developing solution.

7 Claims, 11 Drawing Sheets

PROCESSING APPARATUS FOR LIGHT-SENSITIVE MATERIALS

BACKGROUND OF THE INVENTION

The present invention relates to a processing apparatus for light-sensitive materials wherein a light-sensitive material is processed while it is conveyed by a plurality of conveyance rollers and is soaked in a developing solution.

In general, for processing for exposed light-sensitive materials in a processing apparatus, the exposed light-sensitive materials are passed successively through a plurality of processing tanks (a developing tank, a fixing tank and a washing tank) arranged in the processing apparatus for light-sensitive materials, each providing prescribed processing to the exposed light-sensitive materials. Inside and outside the processing apparatus, there are provided plural sets of paired conveyance rollers for conveying light-sensitive materials in a way of sandwiching them.

Since a light-sensitive material comes in contact with the paired conveyance rollers, gelatin and sludge such as Ag, K, S and Al flowing out of the surface layer of the light-sensitive material stick or adhere to the surface of each conveyance roller on the developing tank.

When an amount of sticking gelatin or sludge is increased, there is formed on the surface of a conveyance roller irregularity which applies pressure on the surface of a light-sensitive material, thereby granular black spots corresponding to the pressure are formed on the light-sensitive material, resulting in deterioration of image quality of the light-sensitive material. Therefore, periodic check such as cleaning or the like is needed.

In order to reduce frequency of the periodic check such as cleaning or the like, following studies were made.

(1) It is considered that the surface of a conveyance roller is made to be water-repellent so that gelatin and sludge flowing out of the surface layer of a light-sensitive material hardly stick to the surface of the conveyance roller.

A processing apparatus having a developing tank in which water-repellent conveyance rollers for light-sensitive materials are incorporated was prepared on a trial basis, and when a light-sensitive material was processed by the processing apparatus, image quality obtained from the processing was not excellent due to the water-repellent effect.

(2) On the contrary, a processing apparatus having a developing tank in which hydrophilic conveyance rollers for light-sensitive materials are incorporated was prepared on a trial basis, and when a light-sensitive material was processed by the processing apparatus, image quality obtained from the processing was excellent, suggesting that hydrophilic rollers are preferable. However, it was found, as processing was conducted repeatedly, that image quality obtained from the processing was deteriorated sharply, and maintenance (cleaning) at short intervals was required, resulting in high running cost.

SUMMARY OF THE INVENTION

The invention has been attained with the consideration of the above-mentioned problems, and its object is to provide a processing apparatus for light-sensitive materials wherein intervals of maintenance are longer and high image quality can be maintained stably.

The invention that solves the above-mentioned problems is represented by a processing apparatus for light-sensitive materials which processes a light-sensitive material while the light-sensitive material is being transported and soaked in a developing solution by a plurality of conveyance rollers, wherein the flow velocity of the developing solution in terms of relative velocity viewed from the light-sensitive material is 80 mm/sec or higher on the surface of the light-sensitive material, and a contact angle of a drop of water on the surface of the conveyance roller is established to be 60° or more.

With regard to the aforementioned contact angle, those equal to and greater than 80° are more preferable. The relative velocity means a synthetic flow velocity composed of a conveying speed of the light-sensitive material and a flow velocity of the developing solution.

In FIG. 11, the vector (M) represents the velocity of movement of the conveyed light sensitive material. The synthetic flow velocity (sv) is the vector sum of the developing solution flow velocity (F) and the flow velocity (M') caused on the light sensitive material by the movement of the conveyed light sensitive material.

The location where the aforementioned relative velocity is 80 mm/sec or more may include either a part of a conveyance path for the light-sensitive material or the total area of the conveyance path.

In the processing apparatus for light-sensitive materials of the invention, the flow velocity of the developing solution in terms of relative velocity viewed from the light-sensitive material is made to be 80 mm/sec or higher on the surface of the light-sensitive material, and a contact angle of a drop of water on the surface of the conveyance roller is made to be 60° or more, thereby it is possible to make maintenance intervals longer while maintaining high image quality. Further, even when the contact angle on the surface of the roller is 80° or more, no running out of a developing solution occurs on the surface of the roller, and thereby uneven developing does not occur, resulting in excellent image quality. Owing to the contact angle on the surface of a roller which has been made to be 80° or more, there is no adherence of dirt on the surface of the roller, which makes the maintenance intervals longer.

Incidentally, when a drop of liquid is placed on the surface of an object as shown in FIGS. 10(*a*) and 10(*b*), contact angle θ is defined to be an angle made by the surface plane of the object and a tangent line which is tangential to the drop of liquid at the point where the surface plane of the object intersects the outer surface of the drop of liquid. The stronger the water repellent property of a roller is, the greater the contact angle on the surface of the roller is. Incidentally, the contact angle in the invention is one for a drop of water.

DETAILED DESCRIPTION OF THE PREFERRED EMBODIMENT

Figure 3:
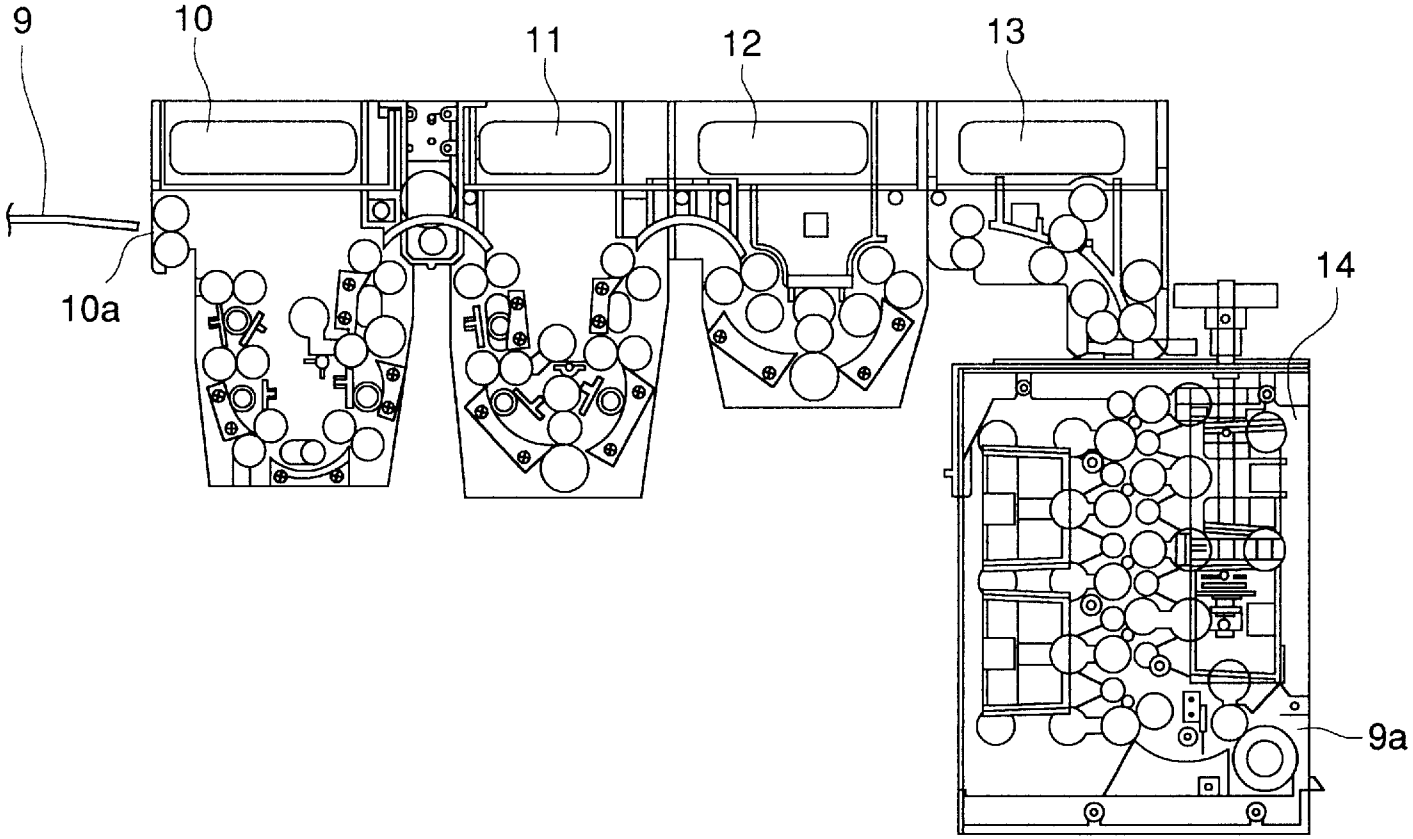
FIG. 3 is a total structural diagram of a processing apparatus for light-sensitive materials in the present example.

First, total structure of a processing apparatus for light-sensitive materials will be explained, referring to FIG. 3 wherein the processing apparatus for light-sensitive materials is composed of five portions. Namely, the five portions include developing section 10 that forms a visual image on light-sensitive material 9 by the use of a developing solution (processing solution), fixing section 11 that fixes on the light-sensitive material 9 the visual image thereon by the use of a fixing solution, water washing section 12 where the fixing solution is washed away, squeezing section 13 where drops of water on the light-sensitive material 9 are removed and drying section 14 where the light-sensitive material 9 are dried by hot air or the like.

Next, the developing section 10 will be explained in detail, referring to FIGS. 1 and 2, wherein the numeral 21 is a developing tank in which a developing solution D is stored. There are provided a plurality of paired rollers 22 which sandwich and convey light-sensitive material 9 along a conveyance path for the light-sensitive material 9. These paired conveyance rollers 22 are provided on rack (frame) 23 arranged in developing tank 21.

Further, on the developing tank 21, two locations on one side of the rack and one location on the other side of the rack both facing a part of the conveyance path for light-sensitive material 9 are provided respectively with developing solution jetting ports 24 jetting developing solution D in the lateral direction of a recording medium.

Rectifying plates 25 are provided to establish the flow velocity of the developing solution jetted from the jetting ports 24 in the lateral direction of the recording medium.

Next, operations in the aforementioned constitution will be explained. Light-sensitive material 9 is inserted through light-sensitive material inlet 10*a* provided on developing section 10, and is sandwiched and conveyed by paired conveyance rollers 22 through developing solution D, and thereby a visual image is formed on light-sensitive material 10 by developing solution D, and the light-sensitive material is conveyed to the following fixing section.

The light-sensitive material 9 on which a visual image is formed is sandwiched and conveyed by paired conveyance rollers through fixing solution F in fixing section 11, thus the visual image is fixed on the light-sensitive material 9 which is then conveyed to the following washing section 12.

When the light-sensitive material 9 is sandwiched and conveyed by paired conveyance rollers through water, fixing solution sticking to the light-sensitive material is washed off, and the light-sensitive material is conveyed to the following squeezing section 13.

In the squeezing section 13, waterdrops sticking to the light-sensitive material 9 are absorbed and removed while they are sandwiched and conveyed by paired conveyance rollers, and the light-sensitive material 9 is conveyed to the following drying section 14.

In the drying section 14, warm air is jetted to the light-sensitive material 9 to dry it. The light-sensitive material 9 which has been dried is ejected out of an apparatus through outlet 9*a*.

Next, experiments described below were conducted under the constitution mentioned above.

(1) Relations between an amount of dirt sticking to a light-sensitive material and a period of usage of a conveyance roller on a developing section were checked by changing the contact angle of a conveyance roller in developing section 10 to four kinds of 50°, 70°, 80° and 100°.

Figure 4:
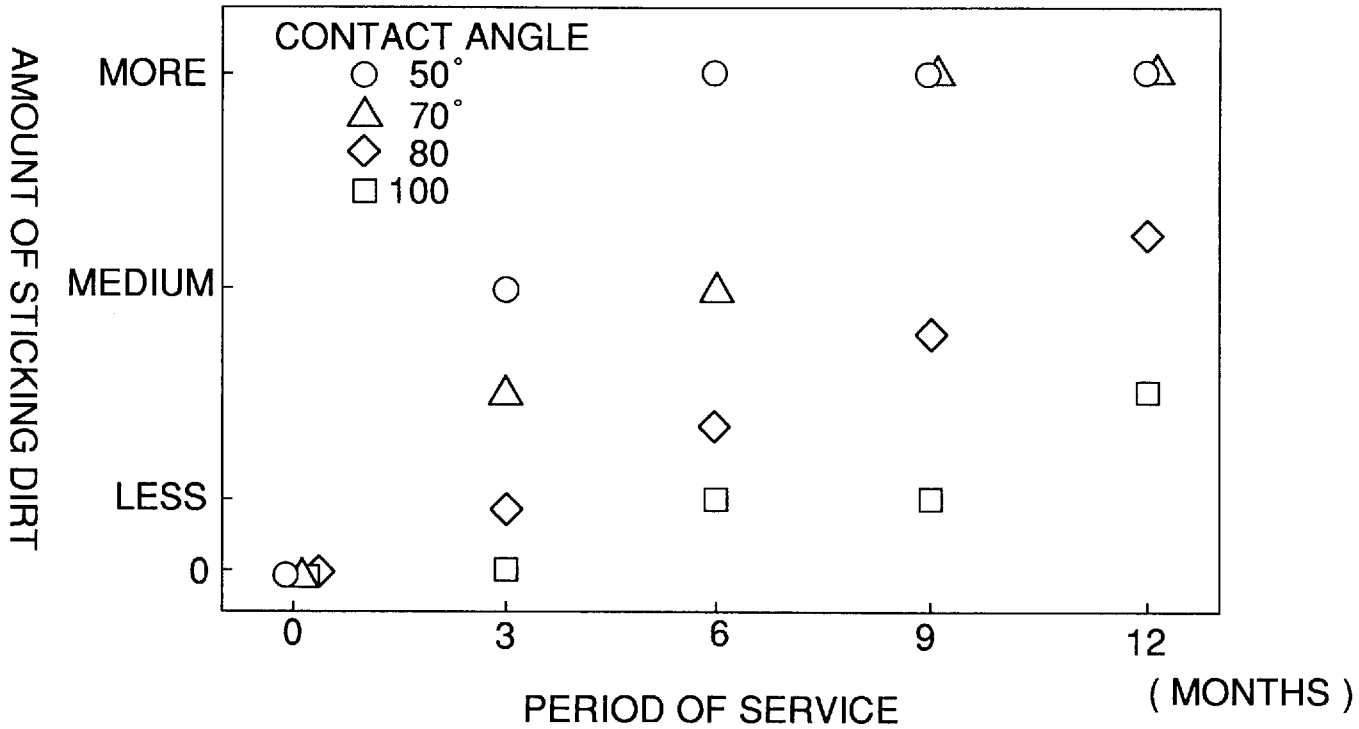
FIG. 4 is a diagram showing relation between an amount of dirt sticking to a light-sensitive material and a period of usage of a conveyance roller on a developing section.

As is apparent from FIG. 4, it was found that the greater the contact angle is, the less the amount of dirt sticking in the same usage period is.

Incidentally, Teflon-coated Bakelite roller and a compound of Bakelite and Teflon were used for a conveyance roller with a large contact angle, and a contact angle on the surface against a waterdrop was made to be 80° or more. Teflon is a trademarked polytetrafluoroethylene and Bakelite is a trademarked phenol formaldehyde resin. It is further possible to use other materials to make a conveyance roller having the same contact angle. For example, acrylonitrile butadiene styrene copolymer, polypropylene, polyphenylenesulfide and polyvinyl chloride can be used.

(2) The inventors of the invention made an investigation about the following points, concerning the relation between image quality of the processed light-sensitive material and a contact angle of a conveyance roller for light-sensitive materials.

Figure 5:
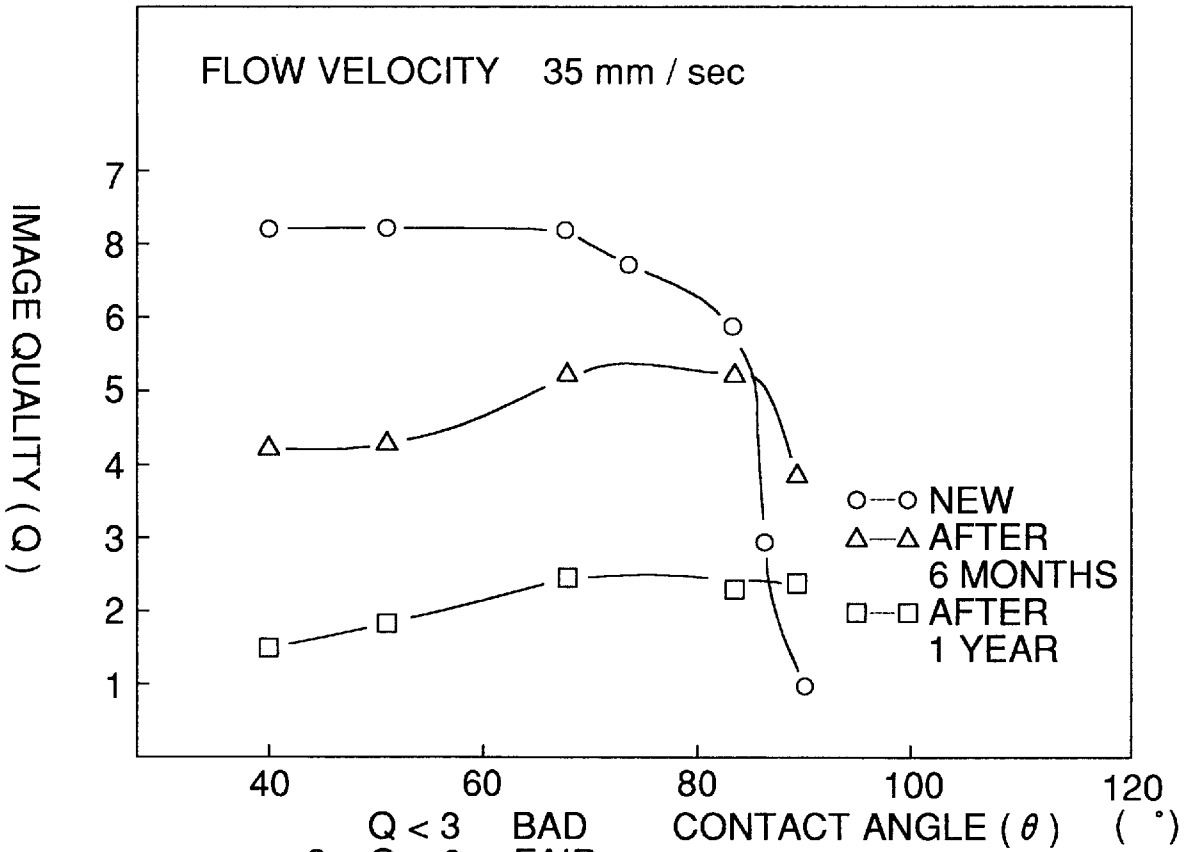
FIG. 5 is a diagram showing relation between image judgment of a light-sensitive material and a conveyance roller contact angle in the case where the relative flow velocity is less than 80 mm/sec in constitution in FIG. 1.

Conveyance rollers for light-sensitive materials each having different contact angle (contact angles calculated by the use of water are 40°, 50°, 55°, 65°, 70°, 80° and 85°) were prepared, and each of them was incorporated in the processing apparatus for light-sensitive materials to conduct continuous processing repeatedly. FIG. 5 shows the results of the processing in which the relative flow velocity was 35 mm/sec as one example lower than 80 mm/sec.

Namely, when the contact angle is smaller than 50°, gelatin or sludge of Ag, K, S or Al tends to stick to the surface of a conveyance roller, and thereby, the surface of the conveyance roller is contaminated and worn away promptly, resulting in deterioration in superficial shape of the roller caused by the aforementioned contaminated substance in the course of processing. Namely, unevenness of the surface of the roller applies pressure corresponding to that unevenness on the light-sensitive material, causing granular black spots to be generated on image quality of the light-sensitive material. In addition, the surface of the light-sensitive material is scratched by inorganic sludge, and omissions of matting agent and others are caused accordingly.

In the initial stage such as the start of using a processing apparatus, there is no problem on processed image quality. However, as the processing is conducted repeatedly, the processed image quality is deteriorated sharply. Even when the rollers are cleaned, accelerated abrasion on the surface of the roller made it impossible to restore to the initial level of processed image quality.

On the contrary, in the case of one which is highly water-repellent with a contact angle exceeding 80°, the surface of the roller showed poor water retention, and thereby liquid shortage on the surface tended to happen. The portion where the liquid shortage took place showed poor image quality due to uneven developing caused by delayed progress of processing. Incidentally, in this particular case, the image quality was poor from the initial stage such as start of using the processing apparatus.

Incidentally, in the case of good water retention of the surface of the roller, even when the light-sensitive material is sandwiched and pressed, moisture or processing solution exists between the surface of the roller and the surface of the light-sensitive material. Under such condition, therefore, processing can be advanced.

On the contrary, when there was used a processing apparatus in which conveyance rollers whose contact angles are within a range of 60°–80° are incorporated, processed image quality was less deteriorated despite repeated processing, which made it possible to reduce the frequency of cleaning to a certain extent, and image quality was satisfactory.

However, it was found that even when the roller having a contact angle ranging from 60° to 80° is used, image quality on a light-sensitive material is deteriorated by dirt sticking to the roller if an interval of maintenance is 3 months or more.

Figure 6:
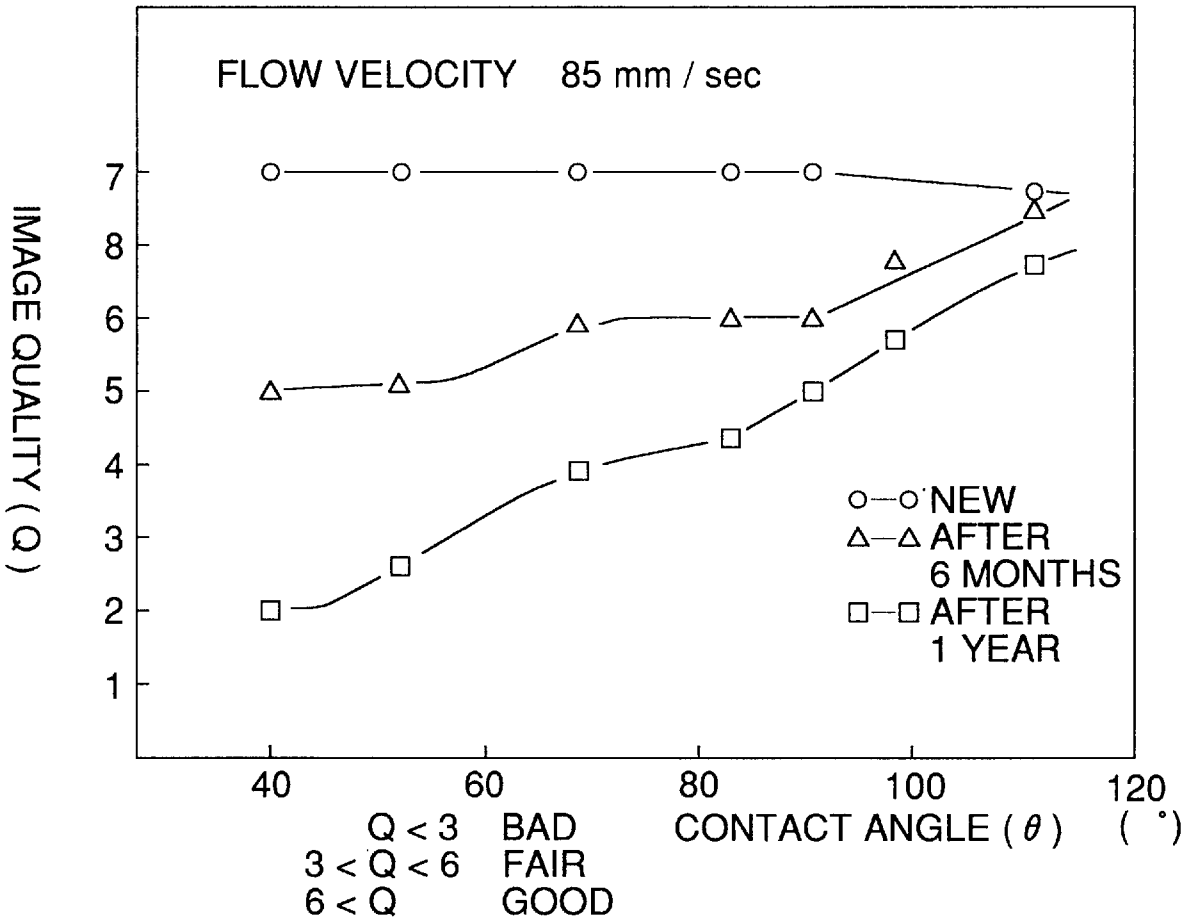
FIG. 6 is a diagram showing relation between image judgment of a light-sensitive material and a conveyance roller contact angle in the case where the relative flow velocity is 80 mm/sec or more in constitution in FIG. 1.

(3) Therefore, image quality on light-sensitive material 9 was checked after establishing the flow velocity of developing solution D of developing section 10 in terms of relative velocity 80 mm/sec or higher viewed from the light-sensitive material 9 on the surface of the light-sensitive material, and changing contact angle of the conveyance roller. FIG. 6 shows data when the relative velocity was 85 mm/sec as one example higher than 80 mm/sec.

As shown in FIG. 6, image quality was improved by the relative velocity set to 80 mm/sec or more, and further, the image quality was not deteriorated even when the contact angle was made to be 80° or more.

It was confirmed that the maintenance interval of about one year did not cause any problem when the contact angle was set to 80° or more and the relative velocity was set to 80 mm/sec or more.

This is considered that the flow velocity of developing solution D in terms of relative velocity viewed from the light-sensitive material 9 set to 80 mm/sec or higher on the surface of the light-sensitive material 9 caused neither shortage of developing solution D on the surface of the roller nor unevenness of developing, resulting in excellent processed image quality.

Explaining in a further detailed manner, supply of a developing agent and discharge of an inhibitor are conducted on the surface of a film in the course of developing, and a boundary layer of inhibitors discharged from the film is formed on the surface of the film accordingly, as the developing step advances. This boundary layer prevents a developing agent in a processing solution from reaching the film surface, and thereby, rapidity of development processing is retarded.

In the past, the rapidity of development processing has been enhanced by destroying or thinning the boundary layer through an increase in the number of contact surfaces between the film surfaces and rollers, in other words, an increase in the number of film rolls. However, the increase of the number of contact surfaces of rollers has a disadvantage that an apparatus is made larger, which is against the downsizing of apparatuses.

In the invention, the rapidity of development processing is enhanced by increasing the relative velocity between a film and a processing agent, and thereby by destroying or thinning the boundary layer. In this case, when the flow velocity is only increased, regular laminar flow is generated, and boundary layers having a certain thickness are maintained. Therefore, sufficient effects of enhancing the rapidity of development processing are not recognized. According to the experiments conducted by inventors of the invention, it was found that Reynolds number based on viscosity coefficient of a fluid and relative flow velocity needs to be a certain value or more, for attaining sufficient effects, and for processing a light-sensitive material, the above-mentioned effects can be obtained by the relative flow velocity of 80 mm/sec or more.

Next, with regard to the contact angle of a roller, it has been 60° or less in the past, for supplying a developing solution to the film surface uniformly, namely, for improving wettability on a roller, When the contact angle of the roller is 60° or less, however, there is recognized a tendency that dirt in a developing tank (silver sludge, precipitated substances and gelatin etc.) sticks to the roller to cause the surface of the roller to be a rough surface, and therefore, uneven pressure is applied on the developed silver to cause deterioration of image quality. On the other hand, when the contact angle of the roller is 60° or more, dirt in a tank hardly sticks to the roller to reduce deterioration of image quality caused by uneven pressure. When the contact angle of the roller is 80° or more, there is recognized a tendency that a roller repels water more strongly, causing uneven supply of solution to a film, and image quality is deteriorated by uneven image quality corresponding to a pattern of the uneven supply of solution, though adhesion of dirt to a roller is further reduced.

In the invention, it is possible to enhance rapidity of development processing and to maintain the rapidity for a long time by setting the relative flow velocity to about 80 mm/sec or more and setting the contact angle to 60° or more. In particular, there was obtained unexpected effect that unevenness of image quality caused by repelling of solution by a roller observed when the contact angle of a roller is 80° or more can be improved by setting the relative flow velocity to about 80 mm/sec or more. The basis for this unexpected effect is considered that uneven supply of solution is improved by the developing solution located between a roller and a film and is running at high speed in a developing solution, thus unevenness hardly occurs. It is further considered that due to the effect of rapid processing, development processing is mostly finished in the first half of a developing step and thereby no influence of unevenness of solution supply in the second half is given, which does not lead to image quality unevenness, although uneven supply of solution is caused by solution repelling on a roller which is outside or partially outside a developing solution in the second half of the developing step.

As stated above, since image quality unevenness caused by solution repelling can be prevented by setting the relative velocity to about 80 mm/sec or more, the greater the contact angle of a roller is the less the adhesion of dirt to the roller is. However, the contact angle is restricted depending on the material used for the roller. It is therefore preferable that the contact angle is 160° or less. From the viewpoint of practical use, therefore, the contact angle that is not less than 60° and not more than 160° is preferable. The contact angle that is not less than 80° and not more than 120° is more preferable.

Incidentally, from the viewpoint of practical use, the relative flow velocity of about 400 mm/sec or less is preferable.

Figure 7:
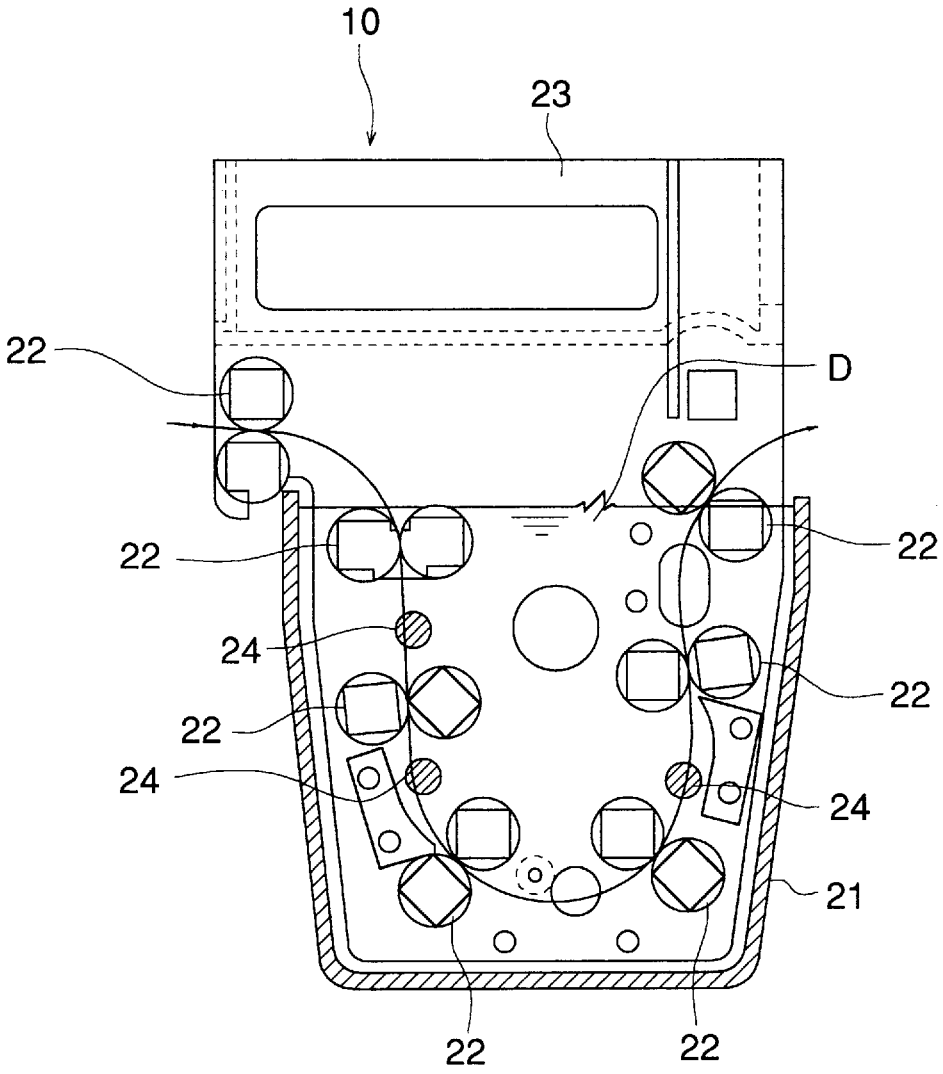
FIG. 7 is a structural diagram of a variation example of the invention.

Next, a variation example of the invention will be explained as follows, referring to FIG. 7. Incidentally, a difference between the variation example and the example in FIG. 1 is that rectifying plate 25 is not used.

Figure 1:
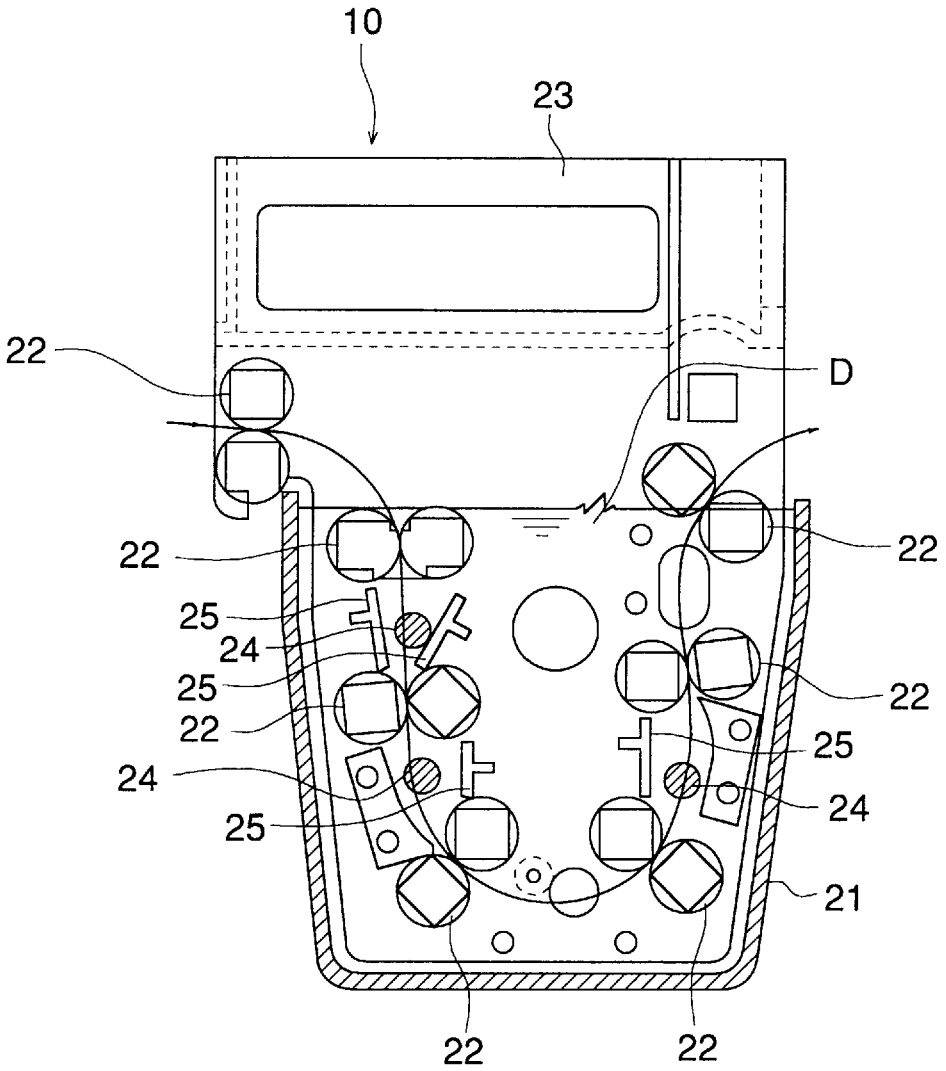
FIG. 1 is a structural diagram of the main sections of a first example of the invention.
Figure 2:
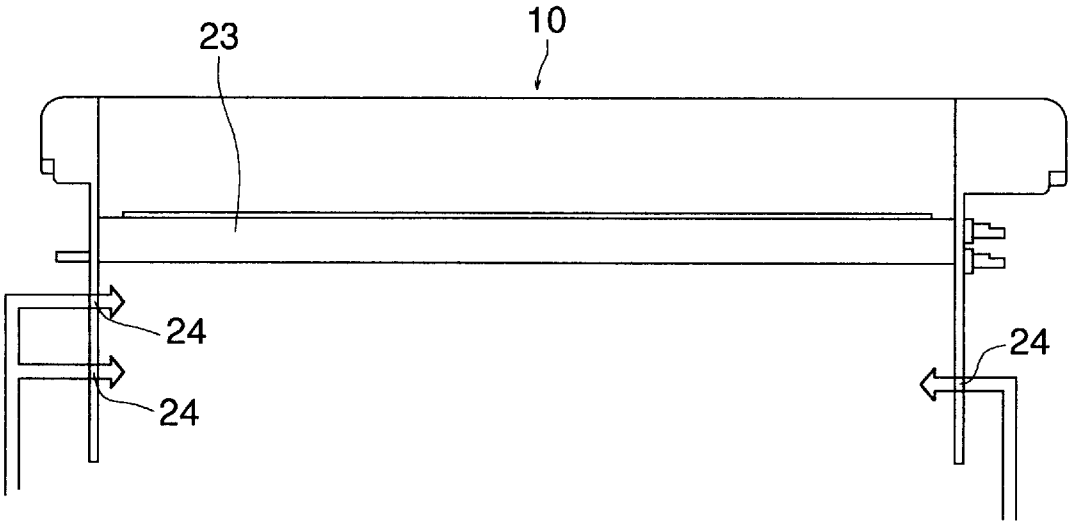
FIG. 2 is a left side view of what is shown in FIG. 1.

Even in the present constitution, it is possible to obtain the same effects as those in the example in FIG. 1.

Figure 8:
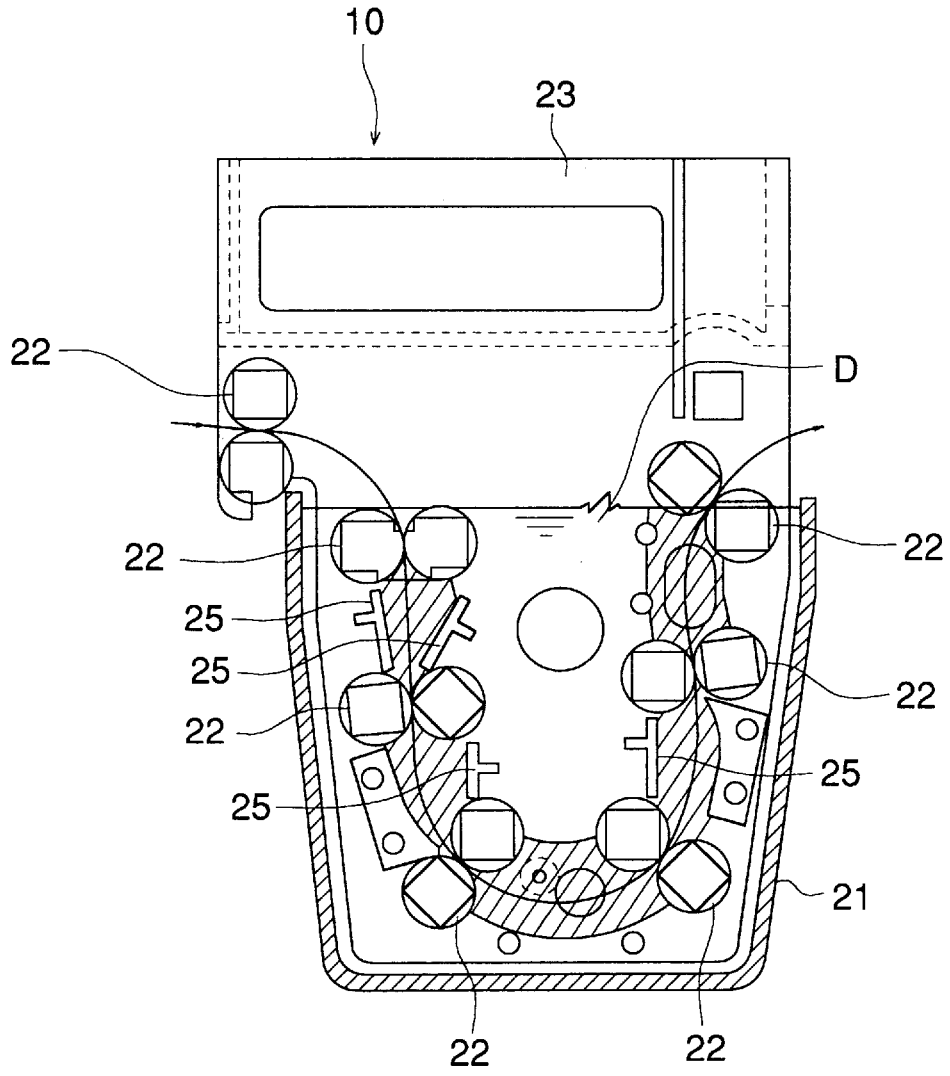
FIG. 8 is a structural diagram of a variation example of the invention.
Figure 9:
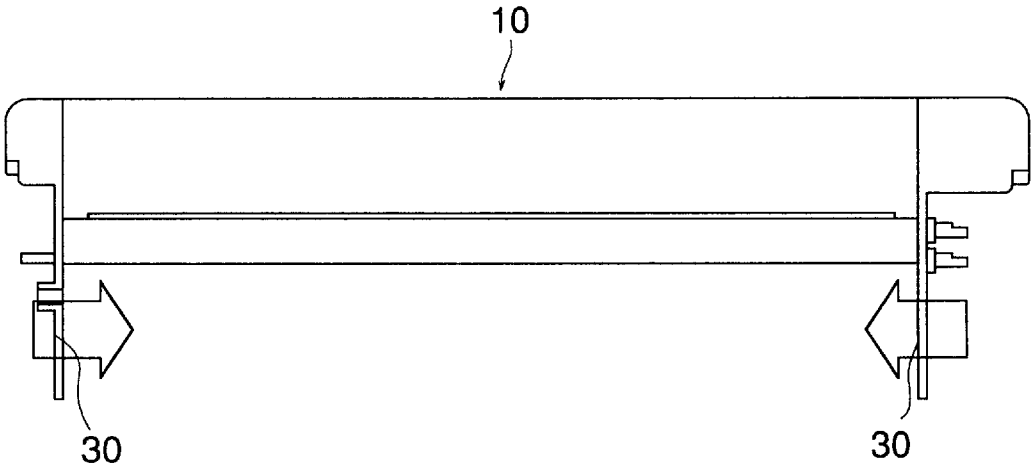
FIG. 9 is a left side view of what is shown in FIG. 8.
Figure 10:
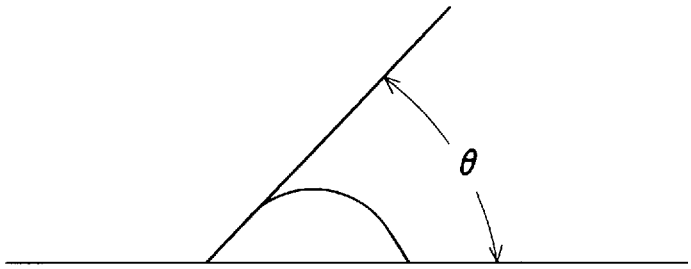
FIGS. 10(*a*) and 10(*b*) represent illustrations relating to a contact angle.
Figure 10:
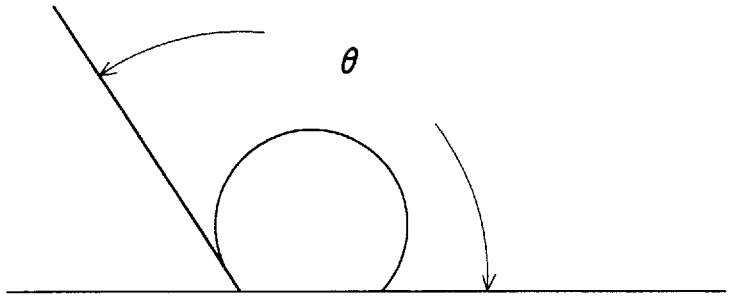
Figure 11:
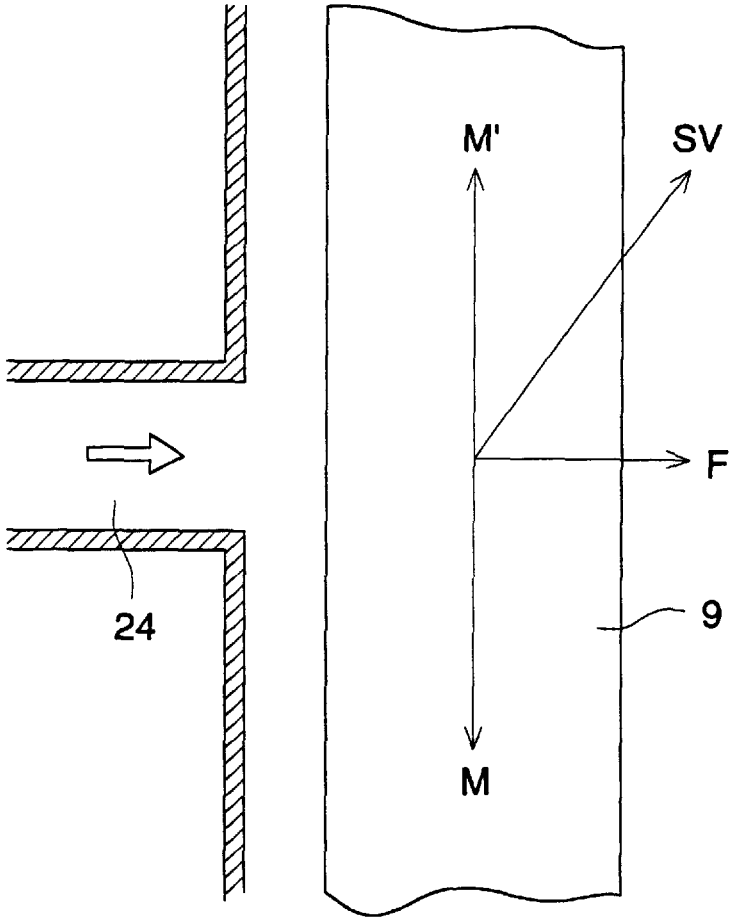
FIG. 11 is a schematic diagram graphically depicting the determination of the synthetic flow velocity (sv).

Further, a variation example of the invention will be explained as follows, referring to FIG. 8. A difference between the variation example and the example in FIG. 1 is that the flow velocity is increased by a part of the conveyance path for light-sensitive material 9 in the example in FIG. 1, while, developing solution flow out port 30 is provided for increasing the flow velocity along the entire area of the conveyance path for light-sensitive material 9 in the present variation example.

Even in the variation example, it is possible to obtain the same effects as those in the example in FIG. 1.

In the processing apparatus for light-sensitive materials of the invention, the flow velocity of a developing solution in terms of relative velocity viewed from the light-sensitive material set to 80 mm/sec or higher on the surface of the light-sensitive material causes neither shortage of developing solution on the surface of a roller nor unevenness of developing, resulting in excellent processed image quality.

It was further possible to prevent adhesion of dirt on the surface of a roller and to make the maintenance intervals longer by setting the contact angle on the roller surface to 80° or more.

What is claimed is:

1. An apparatus for processing a light sensitive material, comprising:

a processing tank in which a developing solution is stored so that the light sensitive material is developed in the processing tank;

a conveyor including a conveying roller for conveying the light sensitive materials at a conveying speed (mm/sec.) on a predetermined passage in the processing tank, wherein a contact angle θ of the conveying roller satisfies the following relation: $60° \leqq \theta \leqq 160°$, wherein the contact angle is defined to be an angle made by a surface plane of the conveying roller and a tangent line which is tangential to a drop of water at the point where the surface plane of the conveying roller intersects the outer surface of the drop of the water; and means for creating a flow of the developing solution at a flow velocity (mm/sec.), wherein a synthetic flow velocity is composed of the conveying speed of the light sensitive material and the flow velocity of the developing solution, and the conveyor and the creating means are adjusted so that the synthetic flow velocity is not slower than 80 mm/sec.

2. The apparatus of claim 1, wherein the contact angle satisfies the following relation: $80° \leqq \theta \leqq 120°$.

3. The apparatus of claim 1, wherein the synthetic flow velocity is not faster than 400 mm/sec.

4. The apparatus of claim 1, wherein the synthetic flow velocity satisfies the relation on a part of the passage.

5. The apparatus of claim 1, wherein the synthetic flow velocity satisfies the relation on all the passage.

6. The apparatus of claim 1, wherein the conveying roller is made of phenol formaldehyde resin coated with polytetrafluoroethylene.

7. The apparatus of claim 1, wherein the conveying roller is made of composition of phenol formaldehyde resin and polytetrafluoroethylene.

* * * * *